United States Patent [19]

Prasthofer

[11] 4,300,723

[45] Nov. 17, 1981

[54] CONTROLLED OVERSPRAY SPRAY NOZZLE

[75] Inventor: Willibald P. Prasthofer, Huntsville, Ala.

[73] Assignee: The United States of America as represented by the Administrator of the National Aeronautics and Space Administration, Washington, D.C.

[21] Appl. No.: 126,138

[22] Filed: Feb. 29, 1980

[51] Int. Cl.[3] ..... B05B 1/26

[52] U.S. Cl. ..... 239/499; 239/589; 239/601

[58] Field of Search ..... 239/499, 589, 601, 602, 239/458, 514

[56] References Cited

U.S. PATENT DOCUMENTS

| | | | |
|---|---|---|---|
| 1,989,696 | 2/1935 | Kelley | 239/458 X |
| 2,175,160 | 10/1939 | Zobel et al. | 239/589 |
| 3,130,920 | 4/1964 | Devillard | 239/601 |
| 3,261,558 | 7/1966 | Davies | 239/601 |
| 3,550,864 | 12/1970 | East | 239/601 |

*Primary Examiner*—Robert B. Reeves
*Assistant Examiner*—Gene A. Church
*Attorney, Agent, or Firm*—Joseph H. Beumer; John R. Manning; Leon D. Wofford, Jr.

[57] ABSTRACT

The invention relates to a spray system for a multi-ingredient ablative material wherein a nozzle A is utilized for suppressing overspray. The nozzle includes a cylindrical inlet (12) which converges at (12*a*) to a restricted throat (13). A curved juncture (15) between cylidrical inlet (12) and convergent portion (12*c*) having a predetermined radius of curvature affords unrestricted and uninterrupted flow of the ablative material. A divergent bell-shaped chamber (14) and adjustable nozzle exit B is utilized which provides a highly effective spray pattern in suppressing overspray to an acceptable level and producing a homogeneous jet of material that adheres well to the substrate.

10 Claims, 4 Drawing Figures

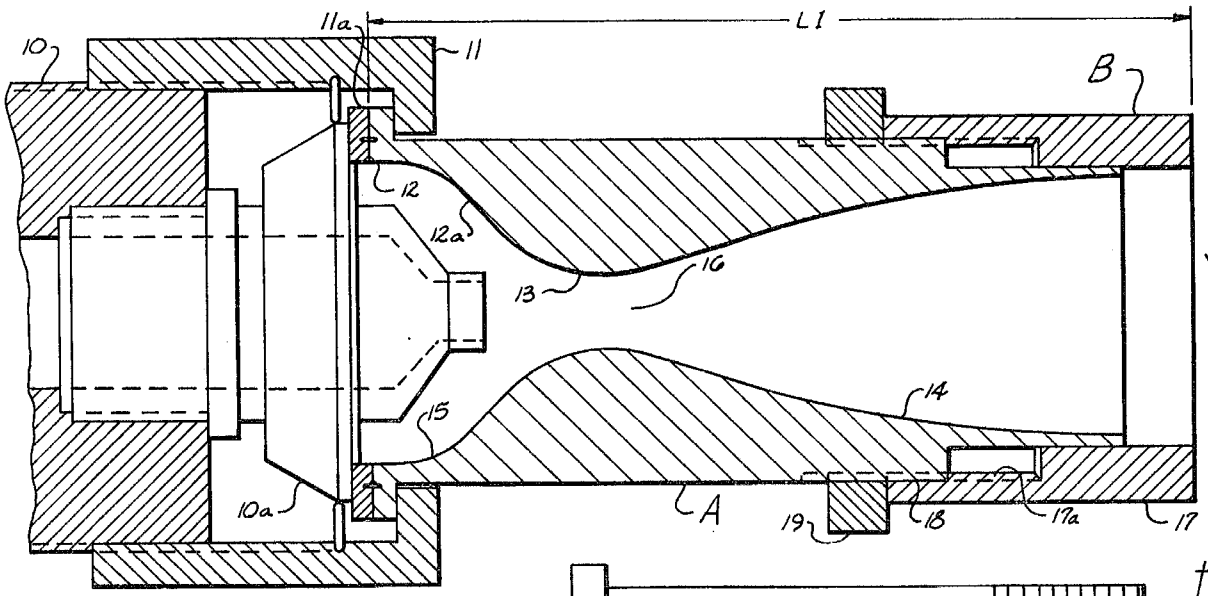
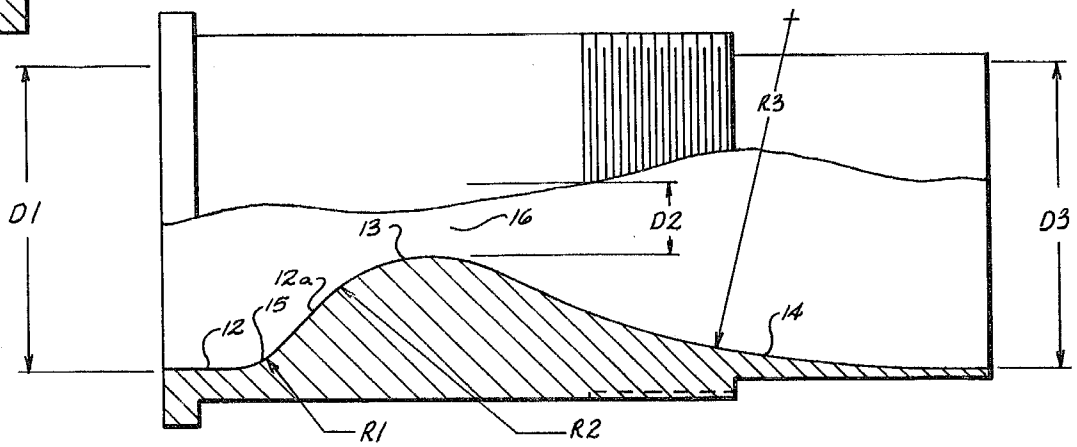
Fig. 2

CONTROLLED OVERSPRAY SPRAY NOZZLE

ORIGIN OF THE INVENTION

The invention described herein was made by an employee of the United States Government and may be manufactured and used by or for the Government for governmental purposes without the payment of any royalties thereon or therefor.

BACKGROUND OF THE INVENTION

Space programs such as the space shuttle program utilize reusable solid rocket boosters which are recovered from the ocean. Adequate protection must be provided for its steel and aluminum parts from heat damage during re-entry and from corrosion in the ocean environment. A low cost, thermal corrosion protective ablative coating, consisting of ten different ingredients, has been developed which includes phenolic microballoons, glass eccospheres, chopped and milled glass fibers to provide its primary insulative properties, an epoxy-polyurethane binder with a catalizer, a suspension agent, and an alcohol activator. Methylchloride and perchlorethylene are added to control viscosity.

The density of these ingredients lies between 0.64 and 1.08 gm/cc. Application of such a composition to create a homogeneous and smooth coating at a uniform thickness in an economical process is a problem which has been given considerable attention. Commercially available spray equipments cause the spray jet to disintegrate prior to impacting the workpiece. Heavy particles of the ablative material concentrate on the inside of the jet while light particles form clouds of fine mist on the outside of the jet causing an undesired overspray. The overspray has to be mechanically removed which upsets the required balance of material adversely affecting the material properties. The removal procedure frequently interrupts the spraying operation, resulting in increased labor costs. Overspray also causes debonding of subsequently sprayed layers which would jeopardize the hardware to be protected by the ablation material.

Attempts have been made to eliminate this overspray by confining the spray jet in metal tunnels and later in an air tunnel framed by four air film panels. It was thought this concept would prevent the spray ingredients from escaping the boundaries of a predetermined spray area but, in practice, a homogeneous spray jet was still not provided.

In attempts to remove the overspray from the workpiece, various mechanical concepts have been proposed. However, problems in positioning and cleaning the device made this method impractical.

SUMMARY OF THE INVENTION

It has been found that conventional spray equipment may be utilized for spraying an ablative material having multiple ingredients of drastically different densities without producing an overspray by utilizing an overspray nozzle affixed to the nozzle of the spray gun which includes a conical inlet having a convergent portion with a very smooth transition from the cone to the throat of the nozzle followed by a divergent bell-shaped chamber having characteristics which afford an uninterrupted flow of the ablative material without buildup in the nozzle. The nozzle end can be extended or retracted to avoid dripping off the nozzle end which occurs when slight changes in the inlet pressures, the pump pressure, or density of the mixture occurs. The nozzle extension also is utilized to obtain optimum smoothness of the coating surface.

Accordingly, an important object of the present invention is to provide apparatus for spraying a multi-ingredient ablative material in a manner in which overspray of the material is effectively controlled and suppressed avoiding this necessity of removal.

Still another important object of the present invention is the provision of an overspray control nozzle which may be fitted to conventional spray equipment by which overspray of a multi-ingredient ablative material may be effectively controlled and suppressed.

Still another important object of the present invention is the provision of an overspray control nozzle for suppressing overspray which includes a conical inlet having a smooth transition to the throat of the nozzle by which unnecessary turbulence is reduced which causes restriction and buildup of the material in the throat area.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 1 is a front elevation illustrating in section, a spray gun and overspray control nozzle according to the invention;

FIG. 2 is an elevation illustrating in partial section an overspray control nozzle according to the invention;

DESCRIPTION OF A PREFERRED EMBODIMENT

Figure 3:
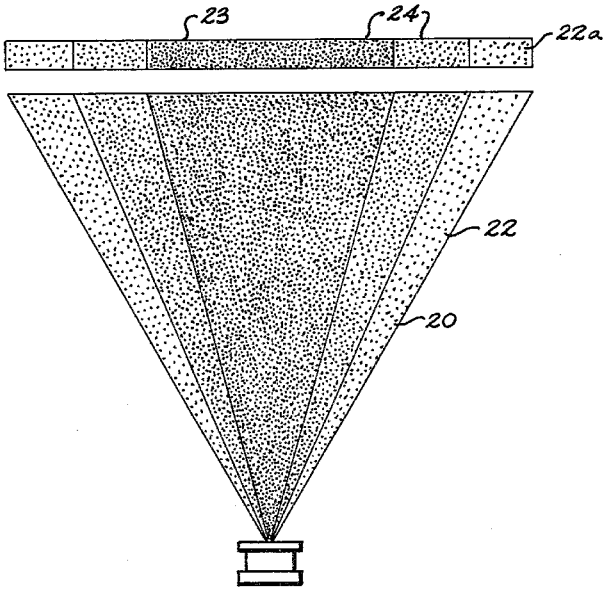
FIG. 3 is an illustration illustrating the problem of ablative material overspray when done by a standard spray gun.

The invention relates to controlling overspray when spraying an ablative material which contains about ten different ingredients four of which, phenolic microballoons, glass eccostheres, chopped fibers, and milled glass fibers provide a primarily insulative property. The chopped glass fibers also help to provide material integrity in concert with the remaining substances.

In accordance with the present invention, an overspray control nozzle has been developed which may be adapted to a conventional spray equipment such as a Binks automatic spray gun, Model 33, which effectively suppresses and controls overspray of an ablative type material mixture and provides smooth, well-bonded coatings.

FIG. 1 illustrates a nozzle A according to one embodiment of the invention adapted to the nozzle end of a Binks automated spray gun 10 by means of a threaded adapter cap 11. A spacer 11*a* is sandwiched between the flange of the nozzle 10*a* of the gun and a flange at the end of nozzle A. As illustrated, the overspray control nozzle A includes an inlet 12 having a diameter D1 which leads to a throat 13 having a restricted diameter D2. The nozzle then diverges, preferably, in a bell-shaped configuration 14 having an outlet diameter D3.

Inlet 12 includes a conical portion 12*a* wherein it has been found critical that a smooth transition from the cylindrical inlet portion 12 to the restricted throat 13 is provided. Accordingly, interior corner 15 at the juncture of surfaces 12 and 12*a* and the transition from the cylindrical inlet 12 to the throat 13 is provided with a radius of curvature R1 and convergent wall portion 12*a* terminates at the throat 13 by means of a radius of curvature R2. In this manner, sharp corners at the conical inlet and the rapidly convergent portion 12*a* are reduced to a suitably smooth curved corner. Unnecessary turbulence which causes an agitating restriction at the throat area and flow interruption are avoided. Due to the multi-ingredient composition and properties of the ablative material being sprayed, an immediate buildup of the material may result, blocking the throat where the transition from the cylindrical inlet to the throat is too sharp and abrupt.

The nozzle A is further characterized by linear dimension L1 which is the length of the nozzle chamber 16 as illustrated. To achieve the desired control of overspray utilizing the control nozzle of the invention and to achieve a smooth well-bonded coating which requires no sanding, the above described shape of the nozzle and dimensions have been found to be very important. With above described conventional spray equipment, an overspray control nozzle with the following dimensions were found to provide excellent overspray control and layer smoothness.

D1=2.56 cm
D2=0.64 cm
D3=2.18 cm
R1=0.64 cm
R2=1.28 cm
R3=7.95 cm
L1=6.41 cm

It has also been found that a nozzle having a straight cone section rather than a bell-shaped cone section may be utilized to suitably suppress overspray. In this respect, a straight cone section of approximately 5 cm measured from the center of the throat to the nozzle end, 0.64 cm throat diameter and a 9° straight cone angle as measured from the horizontal, produces the best results. However, after spraying with a straight cone nozzle an additional effort was frequently added to improve the surface smoothness such as by hand sanding.

The bell-shaped overspray control nozzle was found not only to provide better overspray control but also to provide a more smooth spray coat which would not require additional sanding. It is believed that the jet spray stream is prevented from breaking up by the nozzle characteristics and that the resultant vector of the jet spray is almost parallel to the center of the nozzle when it leaves the nozzle exit.

Nozzle A is provided with an adjustable nozzle exit B which varies the effective length (L1) of the nozzle chamber 16 to compensate for spray conditions which may vary slightly from one spray to another and flow conditions inside the nozzle which may also change causing a change in the quality. The main factors are pump feed pressure, atomizer air pressure, mixture density, and atmospheric pressure. The extendable-retractable nozzle may be adjusted to achieve a constant identical spray pattern at given spray conditions. Prior to spraying, a short duration spray test may be performed in order to adjust the nozzle to its proper length. As illustrated, nozzle exit B includes adjustable end piece 17 having female threads 17*a* mating with male threads 18 formed on the end of nozzle A and suitable lock means in the form of a threaded lock ring 19 for locking end piece 17 in place.

Figure 4:
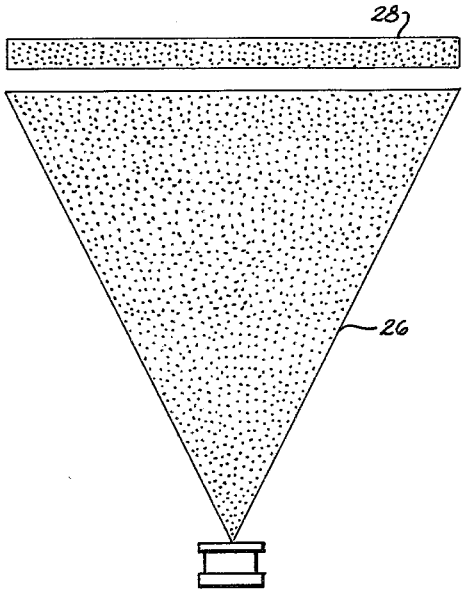
FIG. 4 illustrates a uniform and homogeneous spray pattern achieved by an overspray control nozzle according to the invention.

FIGS. 3 and 4 illustrate, respectively, the spray jet formation utilizing a standard automatic spray gun and the same spray gun adapted with the bell-shaped overspray control nozzle described above. While these figures illustrate only symbolically the spray coat applied, such differences were observed in actual spray coat testing in the laboratory. The standard spray gun pattern of FIG. 3 shows the spray jet 20 much difused with the lighter particles to the outside at 22 producing an overspray at 22*a* on the substrate 23. A satisfactorily uniform spray 24 is formed only toward the center. In FIG. 4, a uniform and homogeneous spray jet 26 is produced illustrating dramatically, the suppression of overspray or substrate 28.

Thus, it can be seen that a highly advantageous apparatus for controlling overspray of a multi-ingredient multi-density ablative coating material can be had according to the invention which improves the overall efficiency of spraying such a mixture.

Material waste and need for excessive manual labor in finishing the coated surface are substantially reduced. Furthermore, the ablative material may be sprayed continuously by such a nozzle without stopping for removal of overspray or removing of previous layers which will greatly contribute to the economic application of thermal protective coatings.

While a preferred embodiment of the invention has been described using specific terms such description is for illustrative purposes only, and it is to be understood that changes and variations may be made without departing from the spirit or scope of the following claims.

What is claimed is:

1. Overspray control apparatus for use with automatic spraying equipment for spraying a highly dense, multi-ingredient material having particles of varying density and controlling the overspray of lighter particles of said material in the spray coating; said spraying equipment being of the type which includes a spray gun having a nozzle exit for dispensing a jet spray, said overspray control apparatus comprising:

a nozzle adapted for affixation to said nozzle exit of said spray gun device;

said nozzle including a cylindrical inlet portion in which said spray gun nozzle exit is received;

a restricted throat portion spaced from said nozzle exit;

a convergent wall portion extending from said cylindrical inlet portion to said throat portion;

a juncture of said cylindrical inlet and convergent wall portions having a smoothly curved interior corner of predetermined radius of curvature affording a smooth transition between said cylindrical inlet and throat portions so as to avoid restrictions and flow interruption at said throat portions facilitating flow of said dense material therethrough;

said convergent wall portion terminating at said throat portion in a curved portion predetermined radius of curvature;

a divergent chamber extending from said throat portion outwardly to a final nozzle exit; and said cylindrical inlet, convergent wall, restricted throat, and divergent chamber being designed as means to effectively co-mix the individual particle ingredients in said material and form a spray jet so as to substantially eliminate concentration of heavier particles on the inside of the spray and presence of lighter particles on the outside of the spray to effectively reduce overspray of the lighter particles which adversely affect the material properties of the spray coating.

2. The apparatus of claim 1 wherein said divergent chamber includes a bell-shaped divergent chamber having concavely curved walls of radius of curvature.

3. The apparatus of claim 2 including an axially adjustable nozzle exit for varying the effective length of said nozzle chamber to compensate for variations in spraying conditions.

4. The apparatus of claim 3 including lock means for locking the desired axial position of said adjustable nozzle exit.

5. The apparatus of claim 1 wherein the radius of curvature of said curved interior corner is approximately 0.64 cm.

6. The apparatus of claim 1 wherein the ratio of the radius of curvature of said curved interior corner to said curved portion adjacent said throat portion is about 0.5.

7. The apparatus of claim 1 wherein the radius of curvature of said concave bell-shaped chamber is about 7.69 cm.

8. The apparatus of claim 5 wherein the length of said nozzle chamber is greater than or equal to 6.41 cm.

9. The apparatus of claim 8 wherein the diameter of said throat is approximately 0.64 cm and the diameter of said outlet exit is approximately 2.18 cm.

10. The apparatus of claim 5 wherein the radius of curvature of said curved portion adjacent said throat portion is approximately 1.28 cm.

* * * * *